US005758366A

United States Patent [19]

Wilson

[11] Patent Number: 5,758,366

[45] Date of Patent: Jun. 2, 1998

[54] GARMENT BELT

[76] Inventor: Barry E. Wilson, 817 Hillary Ct., Lawrenceville, Ga. 30243

[21] Appl. No.: 781,775

[22] Filed: Jan. 9, 1997

[51] Int. Cl.[6] ..... A41F 3/02

[52] U.S. Cl. ..... 2/338; 2/311

[58] Field of Search ..... 2/338, 311, 237, 2/312, 309, 232, 233, 236, 113, 115, 106, 120

[56] References Cited

U.S. PATENT DOCUMENTS

| | | | |
|---|---|---|---|
| 1,259,234 | 3/1918 | Heath . | |
| 1,987,954 | 1/1935 | Halpern . | |
| 2,869,138 | 1/1959 | Hankoff . | |
| 3,052,890 | 9/1962 | Miller . | |
| 3,086,529 | 4/1963 | Munz et al. | 2/311 X |
| 4,384,583 | 5/1983 | Speelman et al. | 2/338 |
| 4,601,069 | 7/1986 | Fiore, Jr. et al. . | |
| 4,825,475 | 5/1989 | Smart | 2/312 |
| 5,016,291 | 5/1991 | Capper | 2/312 |
| 5,081,714 | 1/1992 | Liu | 2/311 |
| 5,214,805 | 6/1993 | Cochran | 2/338 |
| 5,309,575 | 5/1994 | Lookhoof | 2/312 |

FOREIGN PATENT DOCUMENTS

| | | | |
|---|---|---|---|
| 2280094 | 1/1995 | United Kingdom | 2/338 |
| WO8800011 | 1/1998 | WIPO | 2/338 |

*Primary Examiner*—Gloria M. Hale
*Attorney, Agent, or Firm*—Kenneth S. Watkins, Jr.

[57] ABSTRACT

An elastic belt allows blousing of the lower portion of an upper garment. The belt comprises a longitudinally stretchable strip which is wrapped around the torso of the body and secured with a hook-and-loop fastener component. The belt comprises an inner surface having a high coefficient of friction with the garment material. The outer surface of the belt comprises a matching hook-and-loop fastener component. The hem of the upper garment can be tucked under the inner surface of the belt from the lower side of the belt to form a bloused hem.

6 Claims, 4 Drawing Sheets

GARMENT BELT

BACKGROUND OF THE INVENTION

The present invention relates to garment belts and, more particularly, to elastic belts for upper garments.

Belts are commonly used to secure upper and lower garments. Upper garment belts are useful to secure the lower portion of the garment to the torso for warmth, modesty, or to attain the desired visual effect. Some upper garments are equipped with belt loops, or in some cases integral belts.

Often, an upper garment may incorporate an elastic hem which partially secures the lower portion of the garment to the waist, hip or torso area. The elastic hem may be pulled to an upper portion of the torso to create a "bloused" lower portion. An example is disclosed in U.S. Pat. No. 4,601,069 comprising a garment with an elastic lower hem. The elastic portion engages the torso to provide a garment allowing a bare midriff yet providing modesty to the wearer. Although an elastic hem is useful to create a bloused effect, its use is limited to a particular garment.

Use of a common leather or fabric belt to create a bloused effect is not practical in that the belt would not stay in the position desired by the user. The belt would not be secured to the upper garment unless belt loops were present in the garment. Present belts do not allow convenient use with existing upper garments. Maintaining a wardrobe which includes the features of bloused hems is expensive and requires considerable space.

SUMMARY OF THE INVENTION

Therefore an object of the present invention is to provide an garment belt which allows formation of a bloused hem for virtually any upper garment.

A further object of the present invention is to provide a garment belt which is easily and quickly donned.

A further object of the present invention is to provide a garment belt which will fit virtually any person and can be secured at any portion of the torso.

A further object of the present invention is to provide a garment belt which effectively engages and secures the upper garment in the desired location.

Yet another object of the present invention is to provide a garment belt which is inexpensive and stores conveniently in a small space.

The belt comprises a flat elastic strip which is highly stretchable in the longitudinal direction. The belt comprises a fastener such as a hook-and-loop fastener attached to one end of the strip. In one embodiment, the elastic strip comprises two layers. An inner elastic layer comprises a resilient rubber or plastic material which engages the fabric of the garment due to a high coefficient of friction between the resilient rubber and the garment fabric. The outer layer comprises a fibrous material which acts as a matching hook-and-loop fastener. The two layers are bonded or otherwise laminated.

A second embodiment comprises a third layer comprising a fabric material which protects the inside of the elastic layer from damage due to wear or cutting. In this embodiment the inside surface of the bell may be coated with a non-slip material. In use, the belt is stretched around the waist or upper torso area under the upper garment with the inside surface facing the wearer. The hook-and-loop fastener is engaged to the matching hook-and-loop fastener on the outside surface of the belt. The hem of the upper garment is tucked under the belt from below, forming the bloused hem.

In other embodiments, snap or button type fasteners may be used to attach the belt around the user.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the preferred embodiments of a garment belt which is easy and comfortable to wear and allows the hem or lower portion of an upper garment to be tucked under the belt, forming a bloused hem for the upper garment.

Figure 1:
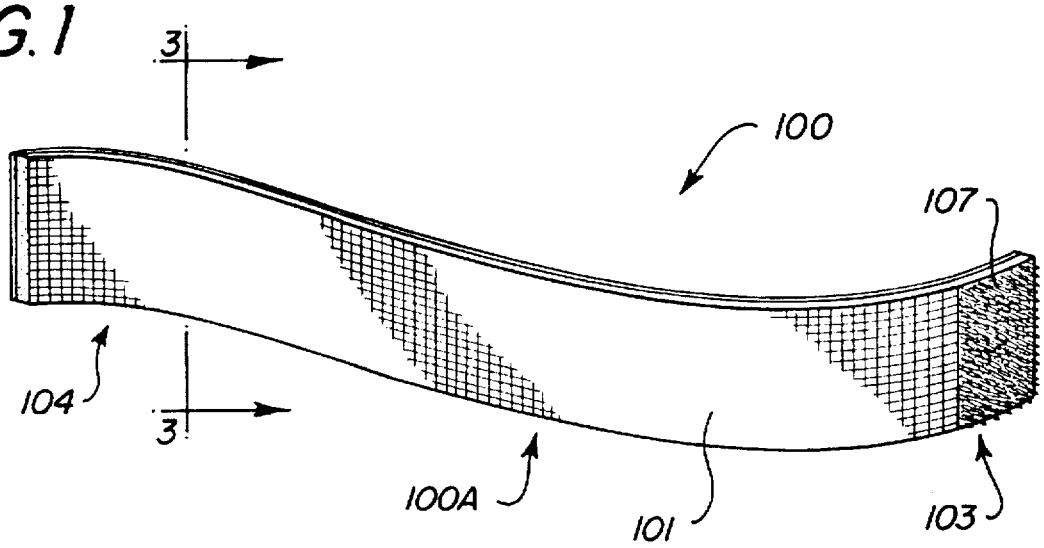
FIG. 1 is a perspective drawing of embodiment 100 of the garment belt.
Figure 2:
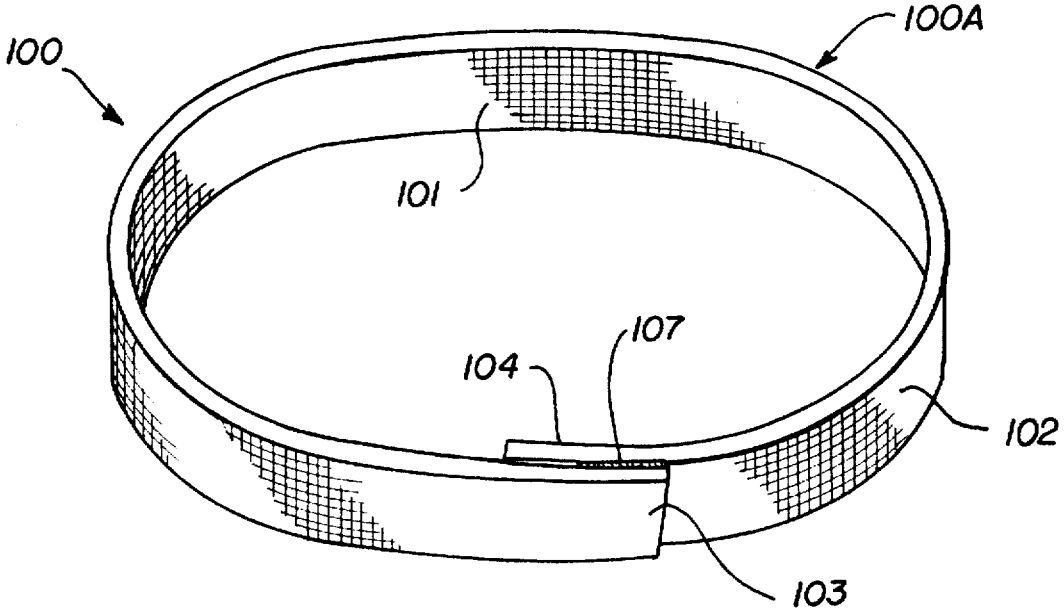
FIG. 2 is a perspective drawing of the embodiment of FIG. 1 with the hook-and-loop fastener component engaged to the matching hook-and-loop fastener component to form the engaged belt.

FIG. 1 and FIG. 2 show the general construction of embodiment 100 of the garment belt. FIG. 1 is a perspective view of garment belt 100 and FIG. 2 is a perspective drawing of the belt of FIG. 1 engaged to form a closed loop as it would be on a wearer. Belt 100 consists of a flat elastic strip 100A and an end fastener component 107. Elastic strip 100A comprises inside surface 101, outside surface 102, attachment end 103 and second end 104. Fastener component 107 is fixed to inside surface 101 of end 103 of strip 100A.

Figure 3A:
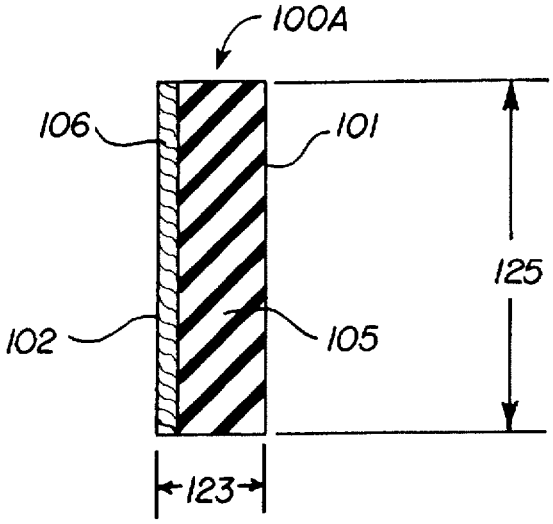
FIG. 3A is a cross section of a two layer embodiment of the garment belt taken at lines 3—3 of FIG. 1.

FIG. 3A is a cross section of a two layer embodiment of belt 100 taken at lines 3—3 of FIG. 1. Strip 100A comprises an elastic layer 105 of a resilient rubber or plastic material and an outside layer 106 of a fabric material. Layer 106 serves as a reinforcement for belt 100 as well as a component of the belt fastening method.

Figure 3B:
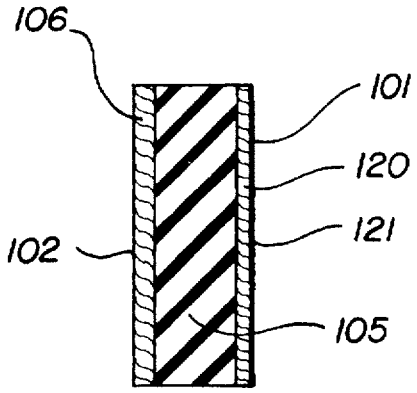
FIG. 3B is a cross section of a three layer embodiment of the garment belt taken at lines 3—3 of FIG. 1.

FIG. 3B is a cross section of a three layer embodiment of belt 100 taken at lines 3—3 of FIG. 1. A fabric inner layer 120 is laminated to elastic layer 105 to provide wear and damage protection for elastic layer 105. Optionally, a non-slip coating 121 may be applied to inside surface 101 to improve grip on the upper garment. Examples of non-skid treatments include polyolefin-based hot melt thermoplastic materials.

In the preferred embodiment, fastener component 107 is a hook-and-loop type fastener component. Fastener component 107 engages outer surface 102 of outside layer 106 as shown in FIG. 2 to secure belt 100 on the torso of a user. Layer 106 serves as a matching hook-and-loop fastener and in the preferred embodiment forms the outside surface 102 of the entire belt. In other embodiments, layer 106 covers only the outside of end portion 104 of belt 100.

As used in this disclosure, the term hook-and-loop fastener component may comprise either hook or loop elements, or both. A matching hook-and-loop fastener component will comprise the complementary element, or both hooks and loops. In the preferred embodiment, hook-and-loop fastener component 107 comprises hook elements, and matching hook-and-loop fastener component (outside layer 106) comprises loop elements as part of the fabric. Layer 106 is bonded with an adhesive to layer 105. In other embodiments, layer 106 is heat bonded, sewn or otherwise laminated to layer 105.

Figure 4:
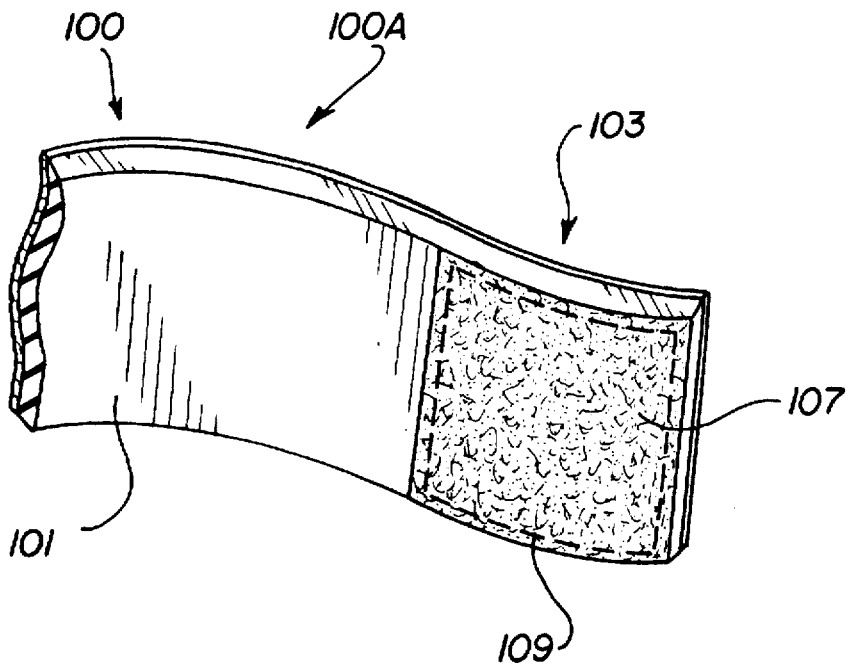
FIG. 4 is a detailed perspective drawing of the hook-and-loop fastener component attached to end 103 of embodiment 100 of the garment belt.
Figure 5:
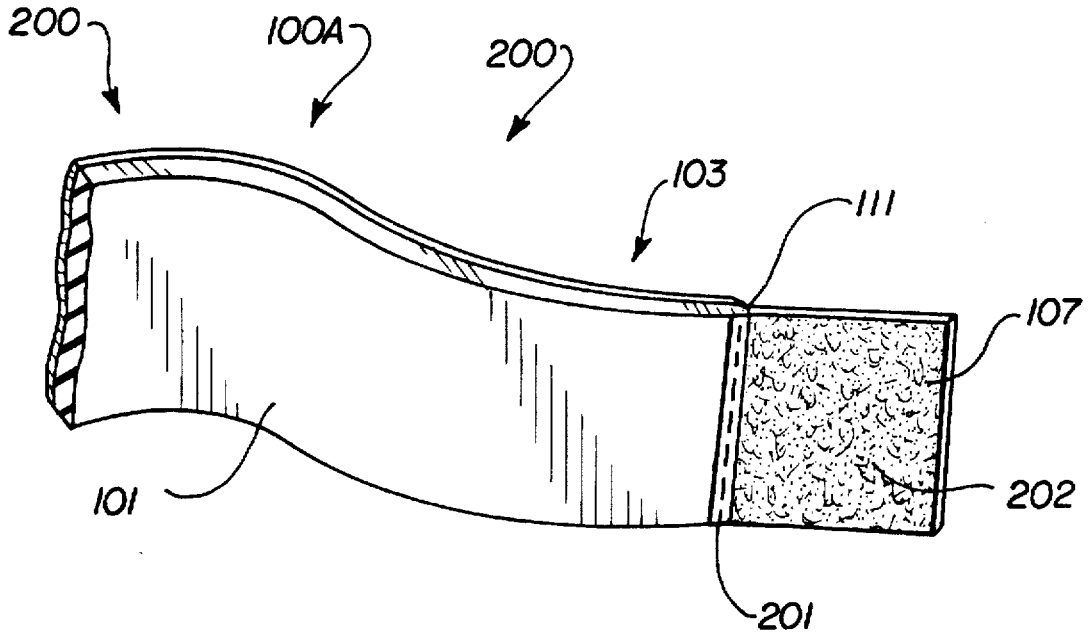
FIG. 5 is a detailed perspective drawing of the hook-and-loop fastener component attached to end 103 of embodiment 200 of the garment belt.

FIG. 4 is a detail perspective drawing of hook-and-loop fastener component 107 attached to end 103 of strip 100A. Fastener component 107 is sewn to inside surface 101 by thread loops 109. FIG. 5 shows embodiment 200 of the garment belt with fastener component 107 attached to edge 111 of end 103. Fastener component 107 may be sewn with thread loops 201 or adhesively bonded to edge 111. In this embodiment, surface 202 of fastener component 107 forms an extension of inside surface 101.

Figure 6:
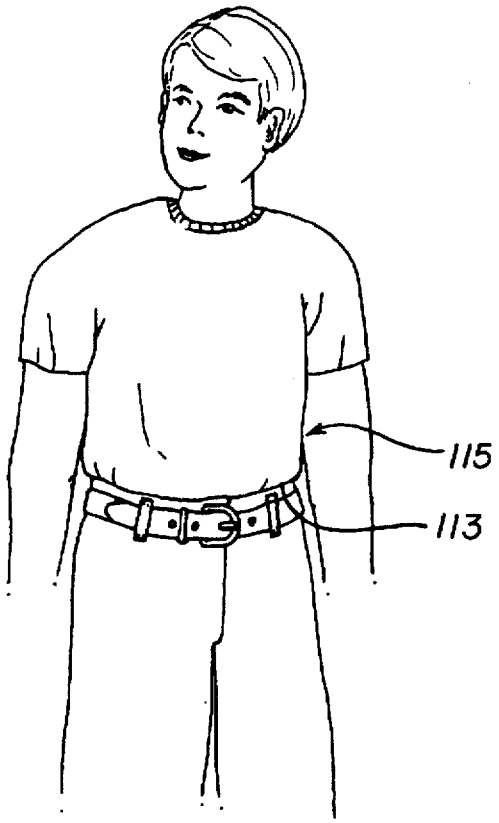
FIG. 6 is a perspective drawing of an upper garment secured to a user by the garment belt.
Figure 7:
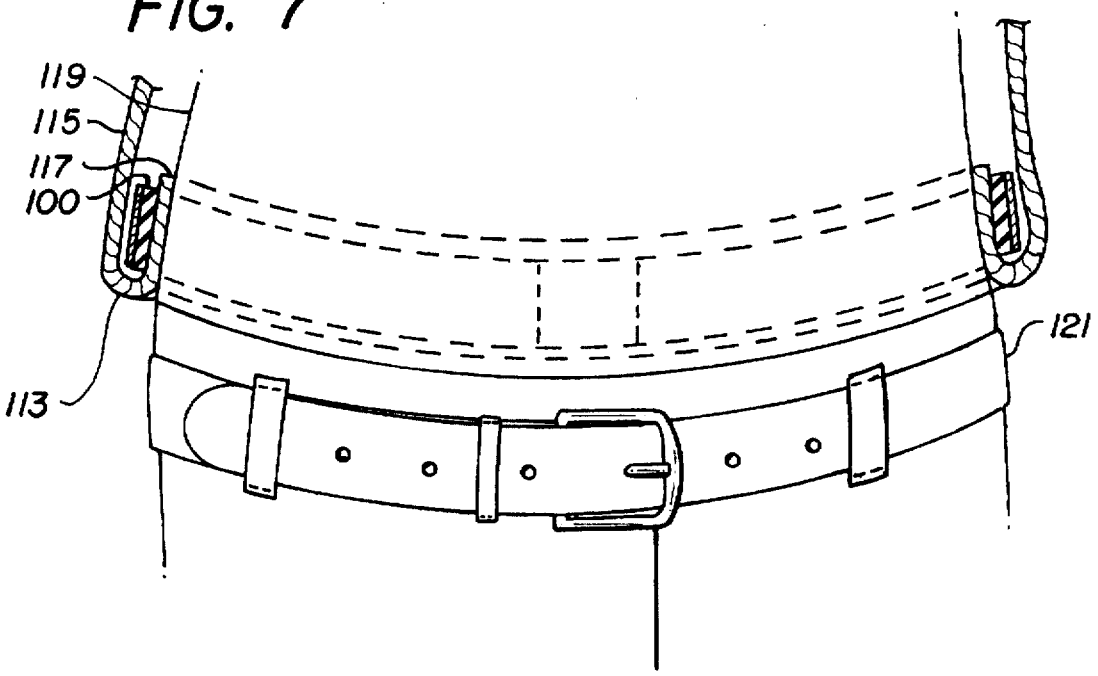
FIG. 7 is a partial cross section of the garment belt engaging the upper garment of FIG. 6.

FIG. 6 shows a bloused hem 113 of garment 115 formed by belt 100 (not shown). FIG. 7 is a partial cross section of belt 100 supporting bloused hem 113. Hem 113 is formed by fitting belt 100 around the waist area of the body, under garment 115, and engaging hook-and-loop fastener component 107 with matching hook-and-loop fastener component (outside surface 102) as shown in FIG. 2. The fit of belt 100 is made snug by moderate stretching of belt 100. The lower portion 117 of garment 115 is tucked under the lower portion of belt 100 to form bloused hem 113. Belt 100 clamps lower garment portion 117 against the body 119. Belt 100 is normally positioned above pants belt 121, but may be positioned anywhere on the trunk of the body.

Figure 8:
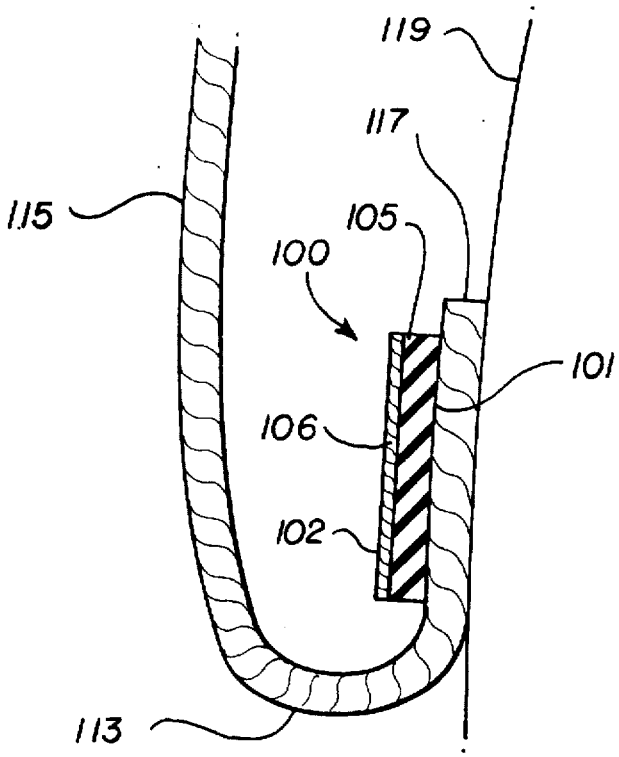
FIG. 8 is a detail cross section of belt 100 engaging the upper garment of FIG. 6.

FIG. 8 is a detail cross section showing engagement of belt 100 against garment lower portion 117. Use of a resilient elastomeric compound such as a closed cell foam rubber as elastic layer 105 improves retention of garment lower portion 117 under belt 100. Belt 100 may be reversed with surface 102 against garment lower portion 117 in applications where slippage of portion 117 is not likely.

The width (125 of FIG. 3A) of belt 100 is typically ½ to 3 inches in order to distribute constricting forces caused by the belt being stretched and fitted over the waist area. Significantly reduced widths result in discomfort to the wearer. The width of the preferred embodiment is 1.5 to 2.5 inches. The thickness (123 of FIG. 3A) of belt 100 should be sufficient to prevent longitudinal crimping or creasing of the belt when stretched and secured in the desired area. The thickness required to prevent crimping and creasing depends on belt width and material of elastic layer 105 and outside layer 106 and is typically ⅛ to ¼ inch. Layer 105 is typically 1/16 to 3/16 inch thick for resilient and foam rubber materials. In the preferred embodiment, layer 105 thickness is ⅛ inch. Outside layer 102 is made from a plush polyester or nylon fabric comprising loops to engage hook-and-loop fastener component 117.

Overall length of belt 100 is typically 20–40 inches in the non-stretched condition. In the preferred embodiment end 104 can be cut to the desired length. Sretchability of belt 100 in the longitudinal direction should be at least 10% so that the belt will remain tight during normal movements of the wearer and to provide comfort. In the preferred embodiment, belt 100 has a stretchability of greater than 50% from the relaxed position without damage or permanent distortion of the belt. In the preferred embodiment, inside layer 105 is made of a closed cell neoprene material. Outside layer 106, which is used in the preferred embodiment as a matching hook-and-loop fastener component, is a made of a #500 series plush nylon cloth of circular knit construction. The inside layer of the preferred embodiment is a lightweight #900 series nylon cloth with a circular knit jersey construction. A laminated product utilizing these materials is available from RUBATEX Corporation, Bedford, Va.

Accordingly the reader will see that the Garment Belt provides a device that secures a bloused hem of an upper garment. The device provides the following additional advantages:

The belt can be quickly donned by the wearer;

The belt can be adjusted to a wide range of sizes and locations on the torso;

The belt can be used with many different types of upper garments; and

The device is simple and low in cost.

Although the description above contains many specifications, these should not be construed as limiting the scope of the invention but as merely providing illustrations of some of the presently preferred embodiments of this invention. For example, buttons or snap fasteners may be used to fasten the belt, or elastic fabrics may be used for the elastic layer, etc. Thus the scope of the invention should be determined by the appended claims and their legal equivalents, rather than by the examples given.

I claim:

1. A belt for forming and securing a bloused hem of an upper garment to a torso, the belt comprising:

a longitudinally elastic strip, the strip comprising a first end, a second end, a first layer comprising a soft resilient material, an inside surface and an outside surface, the strip comprising a predetermined thickness sufficient to prevent creasing when the belt is stretched and secured around the torso;

a hook and loop fastener component fixed to the first end of the elastic strip on the inside surface of the elastic strip;

a matching hook and loop fastener component attached to the outside surface of the elastic strip, the matching hook and loop fastener component comprising a second layer laminated to the first layer of the elastic strip, the second layer forming the outside surface of the elastic strip and extending the length of the strip;

whereby the belt secures a lower hem of the upper garment against the torso forming the bloused hem when the belt is wrapped around the torso and the hook and loop fastener component is engaged to the matching hook and loop fastener component and the lower hem is tucked under the belt.

2. The belt of claim 1 wherein the first layer comprises a closed cell neoprene material and the second layer comprises a plush fabric material.

3. The belt of claim 2 wherein the elastic strip comprises a third layer, the third layer comprising a close weave woven fabric bonded to the first layer, the third layer forming the inside surface of the elastic strip.

4. A belt for securing a tucked hem of an upper garment to a torso, the belt comprising:

a longitudinally elastic strip, the strip comprising a first end, a second end, an inside surface and an outside surface, the elastic strip comprising a first layer of a closed cell neoprene material and a second layer of a looped surface material bonded to the first layer, the second layer extending the length of the strip, the strip comprising a predetermined thickness sufficient to prevent creasing when the belt is stretched and secured around the torso; and a hook fastener component attached to the first end of the elastic strip;

whereby the second layer acts as a matching loop fastener component and the belt secures a lower hem of the upper garment against the torso when the belt is wrapped around the torso and the hook fastener component is engaged to the matching loop fastener component and the lower hem is tucked under the belt.

5. The belt of claim 4 wherein the second layer is a plush nylon fabric.

6. The belt of claim 5 wherein the elastic strip comprises a third layer of a close weave fabric material bonded to the first layer, the third layer forming the inside surface of the elastic strip.

* * * * *